US008825200B2

(12) United States Patent
Carpenter et al.

(10) Patent No.: US 8,825,200 B2
(45) Date of Patent: Sep. 2, 2014

(54) METHOD AND SYSTEM FOR TRACKING OF ITEMS

(75) Inventors: Michael D. Carpenter, Arlington, TX (US); Dale E. Redford, Grand Prairie, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 1238 days.

(21) Appl. No.: 12/266,779

(22) Filed: Nov. 7, 2008

(65) Prior Publication Data

US 2009/0114575 A1 May 7, 2009

Related U.S. Application Data

(60) Provisional application No. 60/986,055, filed on Nov. 7, 2007, provisional application No. 60/992,524, filed on Dec. 5, 2007.

(51) Int. Cl.
*G07F 7/00* (2006.01)
*B07C 7/00* (2006.01)

(52) U.S. Cl.
CPC ..... *B07C 7/005* (2013.01)
USPC ..... 700/224; 700/223

(58) Field of Classification Search
USPC ..... 700/224, 223
See application file for complete search history.

(56) References Cited

U.S. PATENT DOCUMENTS

| | | | | |
|---|---|---|---|---|
| 5,920,056 | A * | 7/1999 | Bonnet | 235/383 |
| 5,923,017 | A * | 7/1999 | Bjorner et al. | 235/385 |
| 6,259,964 | B1 * | 7/2001 | Robinson | 700/224 |
| 6,370,446 | B1 * | 4/2002 | Divine | 700/226 |
| 6,685,031 | B2 * | 2/2004 | Takizawa | 209/546 |
| 7,090,134 | B2 * | 8/2006 | Ramsager | 235/462.13 |
| 2002/0036150 | A1 * | 3/2002 | Knaack et al. | 206/446 |
| 2002/0080031 | A1 * | 6/2002 | Mann et al. | 340/572.1 |
| 2002/0101568 | A1 * | 8/2002 | Eberl et al. | 351/211 |
| 2004/0016684 | A1 * | 1/2004 | Braginsky et al. | 209/702 |
| 2004/0182925 | A1 * | 9/2004 | Anderson et al. | 235/385 |

* cited by examiner

*Primary Examiner* — Stefanos Karmis
*Assistant Examiner* — Michael E Butler

(57) ABSTRACT

The invention provides a system and method for enabling manual sorting items to one of several designated areas associated with delivery destinations. The system includes a conveyor for transporting a stream of items. A video camera is positioned to capture an image of an observation zone to read destination data on the item as it is transported on the conveyor and the location of the item as it continues on the conveyor. A control computer is used in which destination data is stored associating the destination data for an item with a location of the item on the conveyor, and operable to track the location of the item by video tracking with the same camera as the item moves out of an observation zone into an unloading zone. A video projector projects an image onto the item on the conveyor in the unloading zone that includes human-readable instructions for disposition of the item.

5 Claims, 2 Drawing Sheets

METHOD AND SYSTEM FOR TRACKING OF ITEMS

This application claims priority of U.S. Provisional Application No. 60/986,055 filed Nov. 7, 2007 and of U.S. Provisional Application No. 60/992,524 filed Dec. 5, 2007.

FIELD OF THE INVENTION

This invention relates to process and systems for tracking an item such as a package as it is being processed for delivery in a facility.

BACKGROUND OF THE INVENTION

Many sorting and loading operations rely on manual identification. manipulation, and segregation according to a distribution system. Parcels in a distribution center of a private courier is one example. As elements of these systems are automated, reliance on human effort and expertise is reduced. In a combined manual/automated system, the interface of the manual aspect to the automated aspect becomes important.

Technology to track moving features in video is now commonplace. Examples include automated surveillance systems and traffic monitoring systems. In these examples, the system monitors a video stream to "track" an automobile crossing a parking lot, or follow the facial features of individuals as they pass, screening against a watch list. This technology has been applied to industrial material handling systems as well, where items commingled on a conveyor can be followed and their association with information regarding their handling can be maintained as they are processed.

The present invention provides a means of communicating information and processing instructions to an operator in a manual sorting environment. Current technology that accomplishes these functions relies on labels and manual markups. Manual markups. Manual markups are typically done by senior operators with specialized expertise.

Ramsager U.S. Pat. No. 7,090,134 describes a system for projecting a handling instruction onto a moving item or parcel. According to Ramsager, the system projects a display onto an item or parcel using an acquisition device to capture indicia on each parcel, a tracking system, a controller or computer to select the display based on the indicia, and one or more display projectors. In one embodiment the display includes or connotes a handling instruction. The system in one embodiment includes a laser projection system to project the selected display directly onto a selected exterior surface of the corresponding parcel, for multiple parcels simultaneously. The system may be configured to move each display in order to follow each moving parcel so that each display remains legible to a viewer in a display zone where handling takes place.

The system as described by Ramsager is hardware intense. It uses an acquisition device to capture indicia about an item moving along a path generally toward a "display zone" and a tracking system to capture a plurality of locations and corresponding times for the item, the tracking system comprising one or more tracking cameras. The present invention seeks to provide a system that accomplish a comparable end result, for example, a sort of packages moving on a conveyor to specified loading docks, with less complexity.

SUMMARY OF THE INVENTION

The invention provides a system for enabling manual sorting items to one of several designated areas associated with delivery destinations. Such a system includes a conveyor for transporting a stream of the items from an area in which sorting of the items takes place to an area where the items are loaded for transport. A video camera is positioned to capture an image of an observation zone to read destination data on the item as it is transported on the conveyor into the observation zone, and is also positioned to capture the location of the item as it continues on the conveyor into an unloading zone. A control computer is used in which destination data is stored associating the destination data for an item with a location of the item on the conveyor, and operable to track the location of the item by video tracking with the same camera used to read the destination data as the item moves out of the observation zone into the unloading zone. A video projector projects an image onto or near the item on the conveyor in the unloading zone, which image includes human-readable instructions for disposition of the item.

The invention further provides a method for sorting items to one of several designated areas associated with delivery destinations. Such a method includes steps of: scanning the items to determine delivery destination data thereon; transporting a stream of the items on a conveyor which transports the items from an area in which sorting takes place to an area where the items are loaded for transport; storing the destination data for computer access; using a video camera, reading destination data on the item as it is transported on the conveyor into an observation zone; and transporting the items further on the conveyor beyond the observation zone into an unloading zone. In a control computer, the method continues by associating the destination data for an item with a location of the item on the conveyor; tracking the location of the mail piece by video tracking with the camera used to read the destination data as the item moves out of the observation zone into an unloading zone on the conveyor; projecting an image onto or near the item on the conveyor, which image includes human-readable instructions for disposition of the item; and manually unloading the item from the conveyor and placing it in a designated transport location as indicated by the projected image. These and other aspects of the invention are further discussed in the detailed description that follows.

For purposes of the invention, "video tracking" refers to a process by which a control computer receiving a video signal from one or more video cameras analyzes the resulting images and determines the positions of known objects as they move within the field of view of the video camera or cameras. Where multiple surveillance zones are used, this also entails determining when an object has left one zone and entered another. An "item" according to the invention is a labeled, sortable three-dimensional object. The word "conveyor" for purposes of the invention does not have the common dictionary definition "anything that conveys"; rather it refers to a mechanical transport system for moving items in a single-layered stream, typically on a moving surface element (belt conveyor) or on rollers which may include power rollers, i.e. a roller conveyor.

BRIEF DESCRIPTION OF THE DRAWING

In the accompanying drawings, wherein like numerals indicate like elements.

DETAILED DESCRIPTION

The invention described herein allows for human expertise to be systematized and encompassed by technology, thus reducing the minimum skill level for operators within these systems. Through the invention, information is projected in an overlay onto or in close proximity to the physical items. Information would be unique to the physical item to which it is associated. Since the items are usually moving during this process, the information overlay should move as well, or the overlay is only projected when the item has reached an unloading position on the conveyor, and does not move with the item. An operator serving a conveyor, responsible for selecting items from the conveyor and placing them in bins according to the disposition recommended by the system, would see the items themselves with a video overlay of information describing the disposition.

Figure 1:
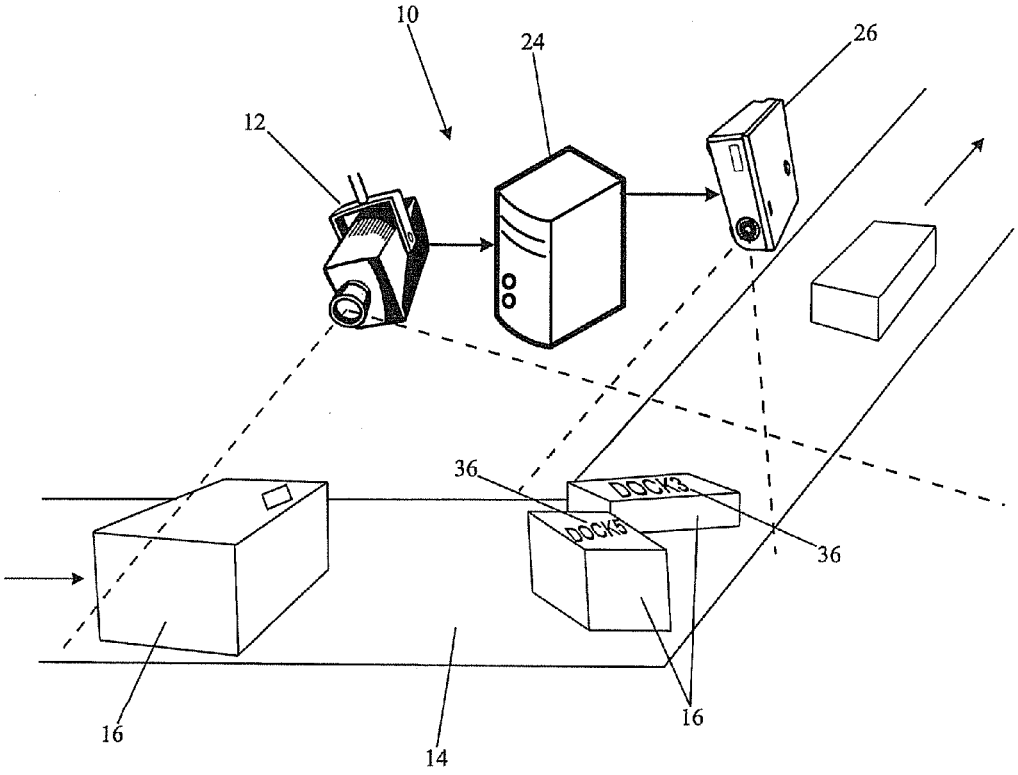
FIG. 1 is a schematic diagram of an a system according to the invention.

Referring to FIG. 1, in a system 10 according to the invention, a video camera 12 is mounted above a conveyor 14, such as a belt or roller conveyor, upon which a single (non-overlapping) layer of items such as parcels 16 for delivery is being transported into a processing and/or distribution system. The camera 12 is the primary machine vision device, and requires adequate resolution for recognition algorithms and at least rudimentary correlation algorithms. The camera 12 should be designed such that all the parcels or other items 16 on the conveyor 14 are adequately focused. Scanning from the bottom side (labels facing down, camera looking up) is one approach that keeps items in focus. However, a further object of the invention is to use a single camera for both reading labels on items entering the disposition area as well as track the movement and positions of parcels within the disposition area. Thus, the arrangement of FIG. 1 puts camera 12 close enough to read a label on the top side of parcel 16 with a wide enough field of vision to continue to track each parcel 16 as it moves into an unloading zone 20 through which conveyor 14 passes. For this purpose, camera 12 could be of a dual focal type capable of receiving a composite image of both the parcel surface (nearer) and the downstream portion of the conveyor 14 (further away). A camera of this type is described in Carpenter et al. United States Patent Application 20060269102, the contents of which are incorporated by reference herein. Labels and other relevant data upon which processing instructions are based are read from the items 16 as they pass through an observation zone 22 which is close enough to camera 12 that label 18 or other markings can be read, and preferably adjacent to unloading zone 20. An advantage of video tracking according to the invention is that the stream of items need not be singulated on the conveyor. It is also possible to project the image accurately even if two items are side by side on the conveyor as shown in FIG. 1.

A control computer 24 receives and analyzes (reads) the image from camera 12. Once the parcel or item is identified, a video projector 26 is positioned to project a light image onto a top surface of parcel 16 or onto a projection area 28 adjacent or near to parcel 16 on conveyor 14. Projection area 28 may be a nearby upper surface of conveyor 14 colored to provide a more readable background for the image from projector 26. Computer 24 can cause projector 26 to track the movement of parcel 26, or in a less complex embodiment, shine onto a fixed area near the end of conveyor 14. A gate 30 can be used to hold the leading parcel 16 off of the projection area 28.

Figure 2:
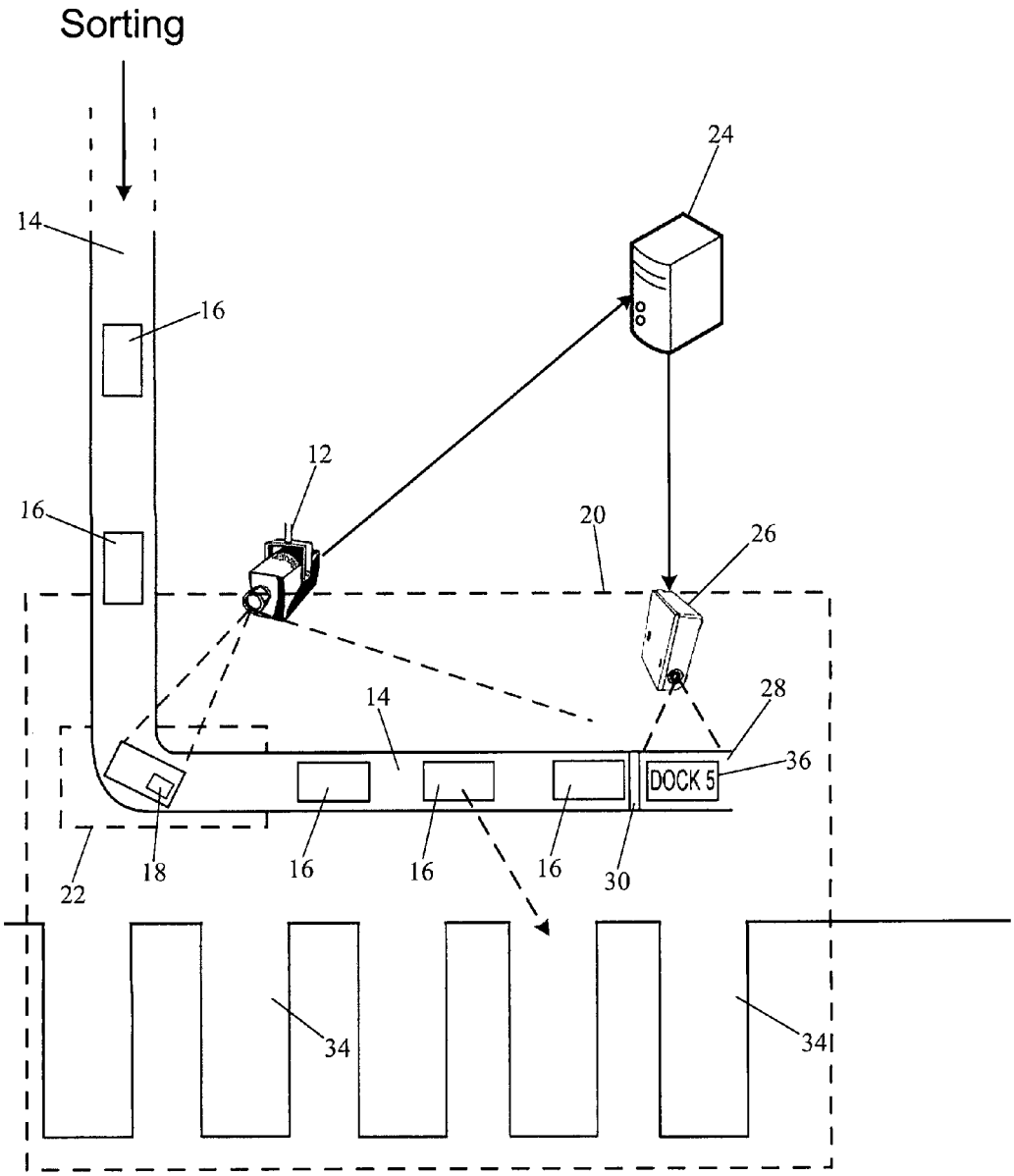
FIG. 2 is a schematic diagram of an item disposition area according to the invention.

As a further alternative, use of camera 12 for reading labels or use of a conventional scanner such as in Ramsager to read information on the outside of item 16 entering the disposition area can be rendered unnecessary if a more comprehensive video tracking system is used, such as that disclosed in the foregoing U.S. provisional application No. 60/992,524 the contents of which are incorporated by reference herein, with or without the use of RFID tags. Upstream from the system of FIGS. 1 and 2, the parcels 16 are sorted, manually or by a sorting machine such as using a tilt tray (or cross-belt) sorting machine of types known in the art. The sorted parcels are transported away from the sorting machine on conveyor 14, brought into unloading zone 20 for manual unloading loading into trucks on loading docks 34.

The parcels are sorted on the basis of a prior scan of the label or the like showing the destination, which scan occurs during or before upstream sorting. Optionally the control computer for the sorting process may at this time mark (print) each label with an unloading instruction symbol. This may be done automatically or as a manual step wherein a human worker views a geometric symbol on a screen as generated by the computer (e.g. circle, square, triangle, cross, double arrow, wavy lines, etc) or an extra large colored number or letter matching signs over the docks) and then marks the item with the matching symbol using a pre-inked stamp or ink jet printer. The control computer 24 receiving a signal from camera 12 in the observation zone 22 looks for one of the symbols, which are easier to recognize in the image data than printing, and activates projector 26 based on the designated symbol. This symbol system can be used with any of the embodiments of the invention described herein.

Since the position of each parcel is continuously tracked following sortation, the control computer 24 knows the destination of each parcel 16 entering the unloading zone 20 so that the correct handling instruction is projected by projector 26. There is no need to read the label on each parcel as it approaches or enters the unloading zone 20, hence there is no observation zone 22 in this embodiment. If control computer 24 thus tracks each parcel or item 16 throughout its progress through the facility from the sorter to zone 20 by means of video tracking, then there is no need to rescan each item as it enters the disposition zone. In a large facility there will be at least one camera per tracking zone though which conveyor 14 passes. Once the item passes out of a zone into an adjacent zone, it is dropped from the map of the zone it is departing and added to the map of the zone it is entering, with occasional confirmation when specific RFID tags pass through a gateway, if RFID tags are used. In this manner the current position of all objects can be tracked.

Video tracking cameras 12 are connected to a control computer 24, either one for each zone, or a single central computer that controls the entire facility. Object recognition software recognizes the outline of the graphical object and determines its current position relative to other recognized objects on the conveyor. It maintains a map in computer memory of the position of the tracked object within each zone or area covered by a camera 12, and continues to track it as it is moved within the zone. It tracks the object based on its shape and movement history. There is no need to read a bar code or other marking on it after the initial scan which takes place before or during initial sortation.

Whether video tracking is used only in the disposition area or throughout the facility, association between the information gained in this process and the physical items is maintained through the video tracking function. Video tracking allows the items visible within the same or subsequent cameras video field to be associated, based on the distance or travel time between the cameras, the shape of the items, and the geometric relationship between adjacent items. Information gleaned from the items is processed to discern the proper handling instructions for each item. These handling instructions are typically associated with removing the item in question from the conveyor and putting it in another specific place, which is associated with a subsequent process or destination. In the loading dock environment, the parcel or item is loaded into the correct truck for shipment.

When the handling instructions are known, the application software overlays the instructions into the video stream, positioning the instructions directly on or near the image of the item with which the information is properly associated. This modified video stream is in turn projected onto the conveyor upon which the physical material is being transported. As noted above either the item 16 or the conveyor surface may be colored in a manner that makes the video projection 36 easier for the human operator to see. The operator serving the conveyor 14 sees each item 16 moving by with a projection 36 overlaid. The overlay would include handling instructions, which the operator follows in dispatching the item, e.g. "fragile, this end up", or "do not stack".

Although the invention has been described with regards to a specific preferred embodiments thereof, variations and modifications will become apparent to those of ordinary skill in the art. For example, the items could be trays of postal mail or packages grouped together in a bag, rather than single parcels as shown. It is therefore the intent that the appended claims be interpreted as broadly as possible in view of the prior art as to include all such variations and modifications.

The invention claimed is:

1. A method for sorting items to one of several designated areas associated with delivery destinations, comprising:

transporting a single non-overlapping layer of items on a conveyor which transports the items to an area where the items are loaded for transport;

storing the destination data for computer access;

using a video camera, reading destination data on the item as it is transported on the conveyor into an observation zone;

transporting the items further on the conveyor beyond the observation zone into an unloading zone;

in a control computer, associating the destination data for the item with a location of the item on the conveyor;

tracking the location of the item by video tracking with the camera used to read the destination data as the item moves out of the observation zone into an unloading zone on the conveyor;

projecting an image onto or near the item on the conveyor, which image includes human-readable instructions for disposition of the item;

manually unloading the item from the conveyor and placing it in a designated transport location as indicated by the projected image.

2. The method of claim 1, wherein the destination data read in the observation zone is a symbol which the control computer associates with the designated transport location.

3. The method of claim 2, wherein the symbol is a geometric symbol.

4. The method of claim 1, wherein the stream includes items side by side on the conveyor.

5. A system for enabling manual sorting items to one of several designated areas associated with delivery destinations, comprising:

a conveyor for transporting a stream of the items from an area in which sorting of the items takes place to an area where the items are loaded for transport;

a video camera positioned to capture an image of an observation zone to read destination data on the item as it is transported on the conveyor into the observation zone, and also positioned to capture the location of the item as it continues on the conveyor into an unloading zone;

a control computer in which destination data is stored associating the destination data for an item with a location of the item on the conveyor, and operable to track the location of the item by video tracking with the same camera used to read the destination data as the item moves out of the observation zone into the unloading zone; and a video projector for projecting an image onto or near the item on the conveyor in the unloading zone, which image includes human-readable instructions for disposition of the item.

* * * * *